United States Patent [19]

Caplan

[11] 4,099,715

[45] Jul. 11, 1978

[54] BOWLING BALL

[75] Inventor: David M. Caplan, Los Alamitos, Calif.

[73] Assignee: AMF Incorporated, White Plains, N.Y.

[21] Appl. No.: 570,397

[22] Filed: Apr. 22, 1975

[51] Int. Cl.[2] ..... A63B 37/10; A63B 43/04

[52] U.S. Cl. ..... 273/63 E; 273/171

[58] Field of Search ..... 273/63 E, 63 B, 63 R, 273/63 A, 63 C, 63 D, 63 G, 63, DIG. 20, 128 A; 35/29 F

[56] References Cited

U.S. PATENT DOCUMENTS

| | | | |
|---|---|---|---|
| 531,103 | 12/1894 | Dokkenwadel | 273/63 R |
| 2,291,738 | 8/1942 | Luth et al. | 273/63 E |
| 3,441,274 | 4/1969 | Collins | 273/63 E |
| 3,591,177 | 7/1971 | Skuse | 273/63 E |

FOREIGN PATENT DOCUMENTS

| | | | |
|---|---|---|---|
| 20,863 of | 1911 | United Kingdom | 273/63 E |
| 27,680 of | 1912 | United Kingdom | 273/63 E |

*Primary Examiner*—George J. Marlo
*Attorney, Agent, or Firm*—George W. Price; Walter Lewis

[57] ABSTRACT

Top weight and/or total weight are adjusted by drilling a hole into the ball along a diameter passing through the center of the top weight area and the center of gravity of total ball weight. Weighted plugs are then located at the two centers by an intervening spacer, and the hole closed by a closure cap.

1 Claim, 4 Drawing Figures

BOWLING BALL

This invention relates to a bowling ball having means for adjusting the top and/or total weight of the ball, and to a method of adjusting the top and/or total weight of a bowling ball.

Figure 2:
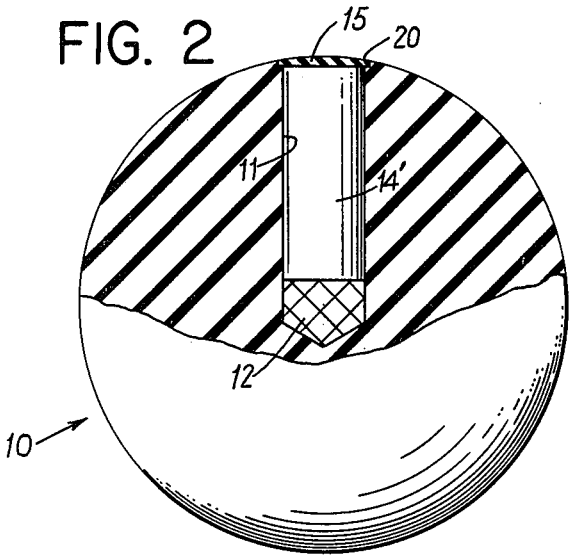
Figure 1:
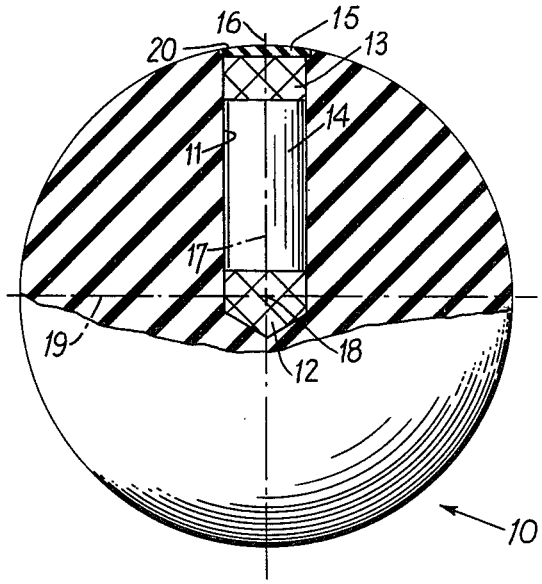

The invention will be best understood by referring to the following detailed description taken in connection with the accompanying sheet of drawing in which FIG. 1 is an illustration of one form of the invention;

FIG. 2 is an illustration of another form of the invention; and

Figure 3:
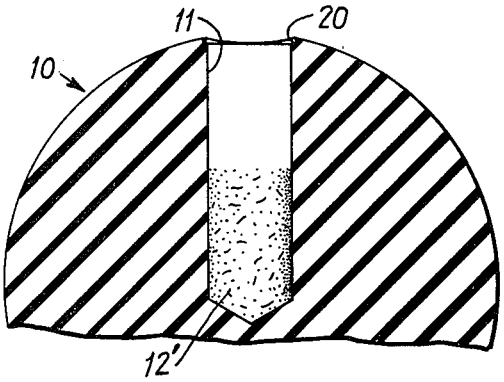
Figure 4:
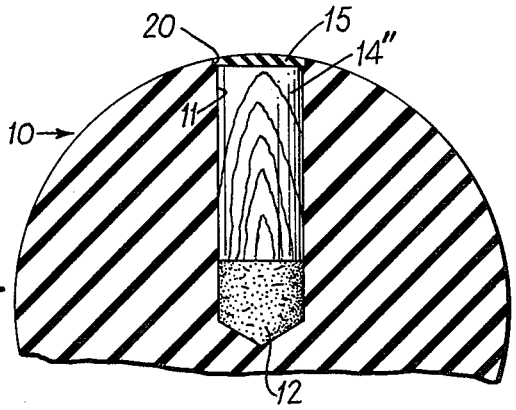

FIGS. 3 and 4 taken together illustrate still another form of the invention.

Referring first to FIG. 1, illustrated therein is a bowling ball 10 having means for adjusting both the top weight of the ball and also the total weight of the ball. The dual weight adjusting means comprises a hole 11 drilled into the ball, a weight 12 positioned at the center of gravity of the ball, another weight 13 positioned at the center of the top weight area for the ball, an intervening spacer 14, and a closure button 15. Preferably the ball is fitted with these parts after the finger holes (not shown) are drilled.

Briefly, in the method, the first step is to determine the center of the top weight of the ball and then to drill the ball in a particular manner. The top weight is determined by positioning the ball on a ring having a jet of air passing therethrough so that the ball is just out of contact with the ring and free to float on the air within the confines of the ring. At first the ball will rotate, but then eventually come to rest. In such rest position the center of the top weight of the ball is positioned at the bottom side of ball at the center of the ring. This area is struck with a pointed instrument to mark the center of the top weight on the ball. In FIG. 1 this mark is designated by the reference numeral 16.

Next, the hole 11 is drilled. The hole is drilled on an axis which coincides with that diameter 17 of the ball which passes through the top weight center mark 16 and the center of gravity 18 of the ball. As a practical matter the center of gravity 18 for the ball almost always is the same as, or nearly the same as, the geometric center of the ball, which is the point at which the diameter 17 and any other diameter 19 for the ball intersect.

The hole 11 is counterbored at the top to provide a shoulder 20 for seating the button 15. The counterbore is to a depth "*d*" which is equal to the thickness of the peripheral edge of the button 15.

The hole 11 is drilled to a depth equal to ½ the diameter of the ball plus ½ the diameter "D" of the hole. This means that the weight 12 is positioned at the center of gravity 18 for the ball 10.

As is common in the art, the composition of the ball 10 is hard rubber or plastic. The parts 12–15 have to be of a similar nature, that is non-metallic, because of A.B.C. (American Bowling Congress) rules. In the FIG. 1 form of the invention, the weights 12 and 13 are compacted slugs of litharge (lead oxide) and the parts 14 and 15 are common hard rubber and/or plastic bowling ball materials.

In the invention, the parts 12–15 have fixed lengths; for example, part 12 will always have a length of about "D", the part 13 will always have a predetermined length of "X", the part 14 will always have a predetermined length "Y", and the part 15 will always have a length "*d*". In other words, no matter what combination of weight addition is selected for parts 12 and 13, all the parts 12–15 will always have the same size and geometry. That is to say, whether the weight addition at 12 and 13 is 1, 2, or 3 ounces, the parts always look the same and the variation in weight is obtained solely by compacting more or less of the litharge into the same size slug. In other words, to get a variation in weight additions at 12 and 13, their size is not changed, but only their specific gravity. This means that by providing a set of the parts 12 and 13, any combination of adjustments in top weight and total weight can be readily made from stocked parts. The parts 14 and 15, of course, will always be of the same size and weight, since these parts merely replace what ball material was removed in drilling the hole 11. It is only at the inserts 12 and 13 that the weight is changed, but not their size.

The three parts 12–14 have a diameter just under "D" for a snug fit in the bore 11, and the part 15 has a slightly larger diameter for a snug fit in the counterbore 20. After the parts 12–15 are nested in position, the button 15 and the ball area contiguous thereto are cemented and/or heated to fuse the interface therebetween, and then this area is sanded and/or polished to finish the ball.

FIG. 2 illustrates the arrangement of the parts when just the total weight of the ball is being adjusted. Here the parts 11, 12, 15, 20 are the same as before, the part 13 is omitted, and the part 14′, which corresponds to part 14 in FIG. 1, is merely made longer to make up for the absence of the top weight insert part 13. If just the top weight were being adjusted, then the part 13 would be present and the part 12 absent, and the part 14′ would be made long enough to reach the bottom of the hole 11.

FIGS. 3 and 4 illustrate an arrangement wherein the weight 12 for adjusting just total weight is formed in situ. Here the necessary amount of granular litharge 12′ to provide the required weight addition is poured into hole 11 and then tamped or compacted in situ into the shape 12 by a wood dowel 14″ or the like and then the hole closed by the button 15. If the top weight of the ball were to be adjusted also, then some granular litharge would be compacted in the hole above the part 14″, which, however, would be slightly shorter than as illustrated; and if just the top weight were to be adjusted, then granular litharge would be compacted just above the part 14″, which however would be somewhat longer than as illustrated in order to reach the bottom of the hole.

It will now be seen that the invention provides a means and method of changing the top weight and/or total weight of a bowling ball, which means and method can be used at the factory or later on when the purchaser is having the ball drilled for his finger holes, and this can be done in such a manner that the center of gravity and side to side balance of the ball are unaffected.

I claim:

1. In a bowling ball, an elongated hole formed therein on a diameter of said ball, said hole having a length equal to the radius of said ball plus one half the diameter of said hole, a closure button for the top of said hole, an elongated spacer in said hole, and a weight in said hole positioned at each of the ends of said spacer, said weights being non-metallic and having a specific gravity which is different from the specific gravity of the material of said ball, said spacer and button being non-metallic and having a specific gravity corresponding to the specific gravity of said ball material, and said button, spacer and weights being snug in said hole and filling the same.

* * * * *